United States Patent [19]

Jones

[11] 4,451,997

[45] Jun. 5, 1984

[54] STRETCHER FRAME FOR HOLDING FABRIC

[76] Inventor: Bruna Jones, 416 Cornell Pl., Ventura, Calif. 93003

[21] Appl. No.: 248,678

[22] Filed: Mar. 30, 1981

[51] Int. Cl.[3] ..... D05C 1/02; D06C 3/08

[52] U.S. Cl. ..... 38/102.2; 160/380

[58] Field of Search ..... 38/102.91, 102.2, 102.1; 242/67.3 F; 160/378, 380, 395; 24/243 K; 52/633, 731

[56] References Cited

U.S. PATENT DOCUMENTS

| | | | |
|---|---|---|---|
| 323,898 | 8/1885 | Anderson | 160/395 |
| 362,429 | 5/1887 | Crowell | 160/380 |
| 1,121,920 | 12/1914 | Haid et al. | 38/102.2 |
| 1,171,952 | 2/1916 | Higgin | 24/243 K |
| 1,250,376 | 12/1917 | Starbuck et al. | 160/378 X |
| 1,484,382 | 2/1924 | Allit | 160/395 |
| 3,076,303 | 2/1963 | Durgeloh | 160/380 X |
| 3,729,045 | 4/1973 | MacDonald | 160/380 X |
| 3,885,333 | 5/1975 | Zachary | 38/102.2 |
| 3,989,396 | 11/1976 | Matsumoto | 52/731 X |
| 4,079,529 | 3/1978 | Jennen et al. | 38/102.2 |
| 4,194,312 | 3/1980 | Connors et al. | 38/102.91 X |
| 4,231,141 | 11/1980 | Derrick et al. | 160/395 X |

FOREIGN PATENT DOCUMENTS

| | | | |
|---|---|---|---|
| 1332868 | 10/1973 | United Kingdom | 38/102.2 |

*Primary Examiner*—Henry Jaudon
*Assistant Examiner*—Andrew M. Falik
*Attorney, Agent, or Firm*—Harry W. Brelsford

[57] ABSTRACT

A stretcher frame for stretching and holding fabric during stitching and/or painting and for permanent display. The stretcher frame includes a first frame member with an outer rectangular U-channel portion and a second frame member having an inner rectangular U-channel portion which fits matingly within the outer U-channel portion of the first frame member so that fabric may be sandwiched between the inner and outer U-channel portions when they are fitted together. Further features are provided to snap-lock the inner U-channel within the outer U-channel and also to provide for removal of the inner U-channel from within the outer U-channel.

5 Claims, 3 Drawing Figures

STRETCHER FRAME FOR HOLDING FABRIC

BACKGROUND OF THE INVENTION

The present invention relates generally to devices for stretching and holding fabric taut during embroidery, stitchery and painting.

Prior devices for stretching and holding fabric taut have been round embroidery hoops, stretcher frames and stretcher bars. The embroidery hoops have been characterized by an inner continuous ring and an outer split ring having some type of adjustment mechanism for varying the size of the outer ring. Typical of such prior art embroidery hoops is the embroidery frame disclosed in U.S. Pat. No. 3,906,647 issued on Sept. 23, 1975. Although the circular adjustable embroidery hoops work very well, because of the rectangular nature of woven fabric, the corners of the fabric cannot be worked in these circular embroidery hoops unless additional fabric is basted to the edges of the embroidery fabric to be held in the hoop. Further, a round hoop must be moved around the fabric to cover the entire design. During this movement, textured stitches may be caught between the inner and outer rings of the hoop and may be flattened. Or, a hoop must be excessively large to contain a centered rectangular design. Also, the finished embroidery or painted work within the circular adjustable embroidery hoops must be removed prior to mounting a suitable frame since hoops with the screw-type adjustment devices characteristically used in adjusting the outer hoop ring are not desirable as display frames.

Other stretcher frames have been proposed such as the tensioning frame disclosed in U.S. Pat. No. 1,093,136 issued Apr. 14, 1914. In this particular frame, tensioning arms are mounted on a rectangular frame. The tensioning arms are rotated into position to thereby stretch the fabric and hold it taut. This tensioning frame, due to the tensioning arms is an unsightly frame for permanent mounting and display of a finished embroidery piece or painting.

Another typical stretcher frame is the needlework frame disclosed in U.S. Pat. No. 4,043,270 issued Aug. 23, 1977. This particular needlework frame is based upon providing two distinct support brackets between which two dowels are rotatably mounted to form a rectangular frame. The fabric is attached to both dowels with stretching being accomplished by suitable rotation of the dowels. Although this particular needlework frame provides convenient stretching of the fabric, it is only a temporary stretching frame and is not suitable for permanent display. In addition to stretcher frames and embroidery hoops, stretcher bars exist, but they need to be assembled and wedged into position. Stationary wooden frames are also used for stretching and holding fabric, canvases or the like. The disadvantage of wooden frames, stretcher bars, and stretcher frames is that in order for the fabric to be stretched onto the particular frame, it must be tacked or stapled into position. Tacking or stapling requires additional tools plus removal of the tacks or staples is difficult. For this reason, once the fabric is stitched or painted, it usually remains on the stretcher bar because of the inconvenience of removing it.

SUMMARY OF THE INVENTION

In accordance with the present invention, a stretcher frame is provided which quickly, conveniently and reliably holds and stretches fabric during stitching and/or painting. Further, the stretcher frame or hoop in accordance with the present invention provides an especially attractive frame which may be utilized to permanently hold and display the finished embroidery piece or painting.

The present invention is based on a stretcher frame having a first frame member with an outer rectangular U-channel portion and a second frame member having an inner rectangular U-channel portion which fits matingly within the outer U-channel portion of the first frame member so that fabric may be sandwiched between the inner and outer U-channel portions when they are fitted together. The inner and outer U-channels are made from resilient plastic in order to provide sufficient flexing of the respective U-channel members to tightly hold variously sized fabric in a stretched condition. Preferably the corners of the polygonal shaped U-channels are rounded slightly to prevent fabric from tearing and to allow fabric to be pulled on the bias to prevent bunching in the corners.

The outer rectangular U-channel portion includes an inward side, outward side and top interior surfaces defining a trough having an open bottom for receiving the inner U-channel portion. As a particular feature of the present invention, a raised rim portion on the inward side of the U-channel interior surface extends around the bottom of the trough to hold the inner U-channel portion within the trough when the inner U-channel portion is fitted within the trough. This type of snap lock fitment prevents inadvertent removal of the inner U-channel from the outer U-channel during stitching and painting. The raised rim portion also prevents loosening or slackening of the stretched fabric during stitching or painting and during permanent display or storage.

In another feature of the present invention a removal flange is provided on the inward side of the outer U-channel exterior surface extending around the bottom of the trough to facilitate removal of the inner U-channel portion from within the outer U-channel portion when desired.

A removal flange is also provided on the inner U-channel portion for facilitating manual removal of the inner U-channel portion from within the outer U-channel portion when desired. The inner U-channel portion includes inward, outward and bottom exterior surfaces. The inner U-channel may be fitted within the outer U-channel so that the inner U-channel bottom surface is adjacent the outer U-channel interior bottom surface. Alternatively, and more preferably, the inner U-channel may be reversed so that the bottom surface of the inner U-channel is displaced away from the outer U-channel bottom and is adjacent the outer U-channel open bottom.

In a further feature of the present invention, the inward side of the outer U-channel is longer than the inward side of the inner U-channel so that the raised portion of the outer U-channel portion snap-locks the inner U-channel portion in place. In addition, the outward side of the outer U-channel portion is shorter than the outward side of the inner U-channel portion so that the removal flange may extend under and outward from the outer U-channel portion to allow manual access for removal.

In accordance with the present invention, the U-channels may be incorporated within ornamental frames or if desired the U-channels themselves may be painted or otherwise colored or treated to provide a pleasing frame appearance which is suitable for permanent display. Application of a simulated wood-grained finish to U-channels is a typical coating which would provide an attractive frame.

As will be realized, the stretcher frame in accordance with the present invention provides a simple and reliable frame which requires no adjustment, may be reused numerous times for different embroidery pieces or paintings or when desired may be utilized as a frame for permanent display of a particular finished embroidery or painting.

The above-discussed and many other features and attendant advantages of the present invention will become apparent as the invention becomes better understood by reference to the following detailed description when considered in conjunction with the accompanying drawings.

DETAILED DESCRIPTION OF A PREFERRED EXEMPLARY EMBODIMENT

Figure 1:
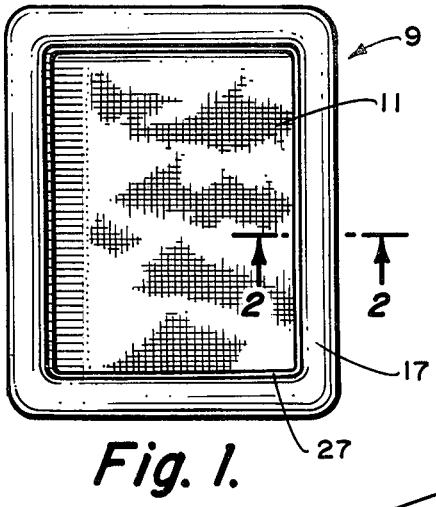
FIG. 1 is a front view of a preferred assembled stretcher frame in accordance with the present invention having a piece of fabric mounted and stretched therein.

A preferred stretcher frame in accordance with the present invention is shown in FIG. 1 at 9. The frame 9 is shown having a piece of fabric 11 mounted and stretched in the frame 9 in accordance with the present invention. The stretcher frame 9 is composed of two basic frame members. The first frame member includes an outer polygonal U-channel portion 10. In the preferred embodiment, the first frame member is a rectangular U-channel as best shown in FIG. 1. It should be particularly pointed out that the outer U-channel portion does not necessarily have to be rectangular. It may be any polygonal shape including triangles, squares, pentagons, hexagons and any other multi-sided closed shape up to and including a circle. Further, although the preferred frame member is simply a rectangular U-channel 10, the frame member may also include any type of desirable ornate frame structure attached to, mounted on or otherwise associated with the U-channel 10.

The stretcher frame further includes a second frame member including an inner polygonal U-channel 12 which fits matingly within the outer U-channel portion 10. As was the case with the first frame member, the preferred second frame member is simply the inner rectangular U-channel 12. Again, it is possible to incorporate or attach ornate frame structures to the inner U-channel 12; however, it is preferred that the second frame member include only the rectangularly-shaped U-channel 12. Since the inner U-channel 12 must fit matingly within the outer U-channel 10, it too may be in the shape of any of the various polygons described above.

The outer U-channel 10 includes inward wall 13, outward wall 15 and top wall 17. Preferably, the walls are made from a resilient plastic. The walls are preferably between 0.010 and 0.10 inch thick. The preferred rectangular hoop has an inside dimension of 5 inch by 7 inch and an outside dimension of 5½ inch by 7½ inch. However, hoops with widely varying dimensions may be made.

The inward wall 13 on its interior surface defines a interior inward side surface 14. The outer wall 15 on its inward surface defines an interior outward side surface 16. The top wall 17 on its interior surface defines a top interior surface 18. The inward side 14, outward side 16 and top 18 interior surfaces define a trough 20 having an open bottom 22 for receiving the inner U-channel portion 12. Preferably, surfaces 14, 16 and 18 are textured to provide a friction against the fabric for a better grip.

Figure 2:
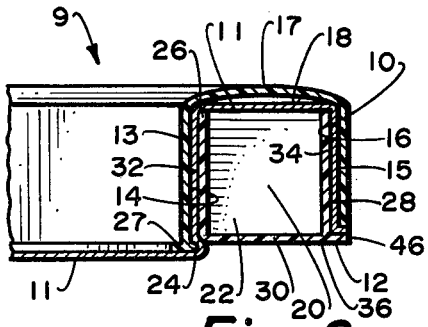
FIG. 2 is a sectional view of FIG. 1 taken in the II—II plane.

Retainer means for holding the inner U-channel portion 12 within the outer U-channel portion 10 as particularly contemplated by the present invention is provided by raised rim portion 24 on the inward side interior surface 14. The raised rim 24 extends along the interior surface 14 around the bottom 22 of the trough 20 to hold the inner U-channel 12 within the outer U-channel 10 in snap-lock fashion when the inner U-channel portion 12 is fitted within the outer U-channel portion 10 as best shown in FIG. 2. The outer U-channel 10 is provided with a removal flange 27. The removal flange 27 extends around the inward exterior surface 13 adjacent to the bottom. The removal flange 27 is designed to facilitate separation of the inner U-channel 12 from the outer U-channel 10 when it is desirable to remove the inner U-channel therefrom. Flange 27 also serves to hold a protective clear plastic sheet over the finished embroidery.

The inner U-channel 12 is also made from a suitable resilient plastic. The inner U-channel 12 includes inward wall 26, outward wall 28 and bottom wall 30. The walls are preferably between 0.01 inch and 0.10 inch thick. The dimensions of the inner U-channel 12 are such that the inner U-channel 12 will fit matingly within the outer U-channel 10. The inward wall 26 includes an inward exterior surface 32. The outward wall 28 includes an outward exterior surface 34. Surfaces 32 and 34 are textured to provide a friction against the fabric for a better grip. The bottom wall 30 includes a bottom exterior surface 36. Although it is not absolutely necessary, it is particularly preferred that reinforcement braces or interior lateral ribs 38 be provided within the U-channel 12 to prevent collapse of the inward and outward walls 26 and 28 during press-fitting into the outer U-channel 10. Braces are not necessary for the outer U-channel 10 since a certain amount of outward flexing of the walls 13 and 15 is expected and desirable during press-fitting of the inner U-channel 12 and the fabric to be stretched within the outer U-channel trough 20.

The inner U-channel 12 is also provided with holes 40 which may be used for hanging the combined frame from a nail, hook or the like.

The inner U-channel 12 is further provided with a removal flange 46. The removal flange 46 extends around the inner U-channel 12 along the outward exterior surface 34 adjacent to the bottom wall 30. The removal flange 46 is designed to allow prying of the inner U-channel 12 out of the outer U-channel 10 when it is desirable to remove the inner U-channel 12 therefrom. It is desirable that the removal flange 46 be continuous around the entire inner U-channel 12 to allow prying of the inner U-channel 12 from within the outer U-channel 10 at any location. However, it is possible to provide removal flanges only at selected positions around the outward exterior surface to allow prying or lifting of the inner U-channel 12 from within the outer U-channel 10 at those locations only. The removal flange 46 may be viewed as an extension of the bottom wall 30 out past the outward wall 34.

As best shown in FIG. 2, it is preferred that the outward wall 15 of the outer U-channel 10 be shorter than the inward wall 13. The inward wall 13 is preferably long enough so that the raised rim portion 24 will snap over the bottom exterior surface 36 of the inner U-channel 12 to thereby hold the inner U-channel 12 within the outer U-channel 10 in snap-lock fashion. The outward wall 15 is preferably short enough so that the removal flange 46 on the inner U-channel 12 will protrude under the outer wall 15 when the inner U-channel 12 is inserted within the outer U-channel 10. Since the inward and outward walls 26 and 28 of the inner U-channel 12 are preferably the same length, it is necessary to stagger the lengths of the inward and outward walls 13 and 15 of the outer U-channel 10 as described above to achieve the desired positioning of removal flange 46 and raised rim portion 24.

Figure 3:
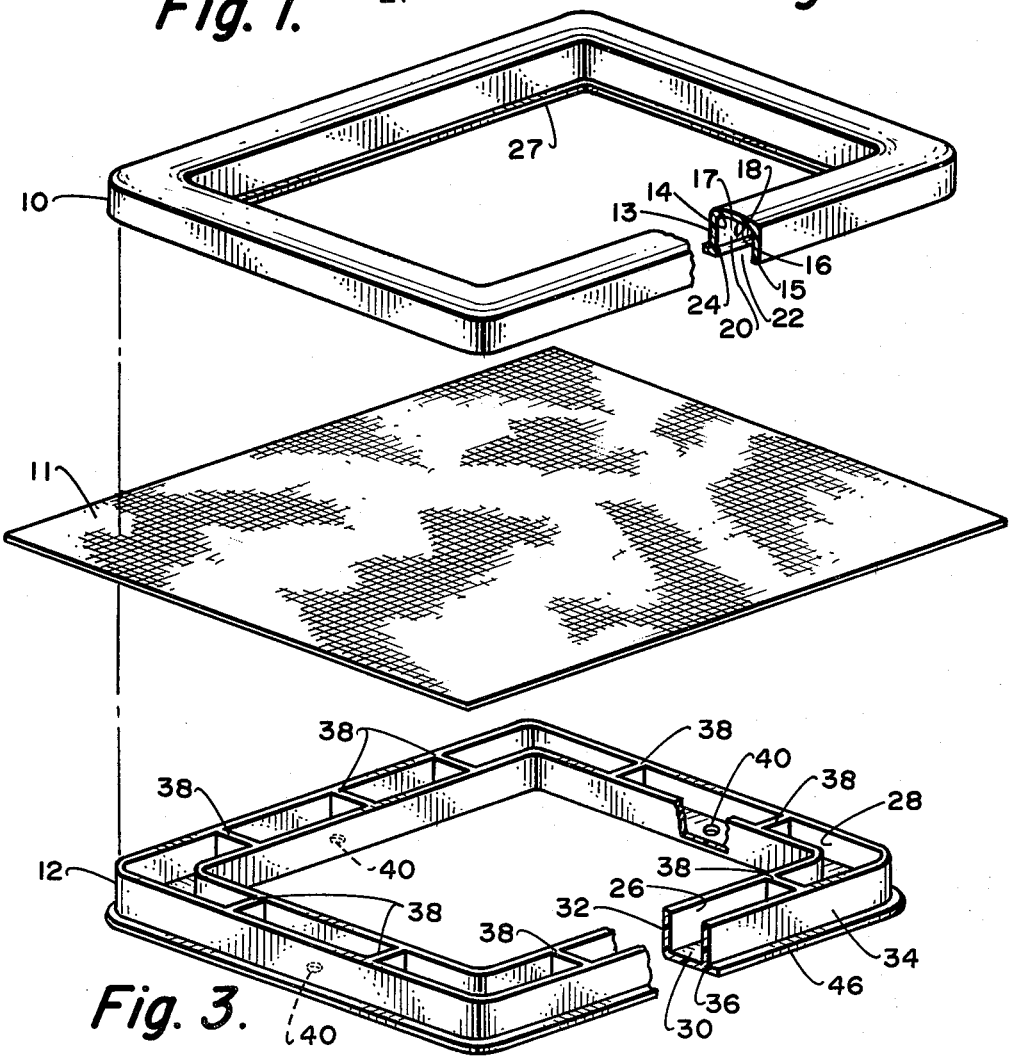
FIG. 3 is an exploded partially sectioned perspective view of the two preferred U-frame members and a piece of fabric.

In FIG. 3, the outer U-channel 10 and inner U-channel 12 are shown prior to being matingly connected with fabric 11 sandwiched in between. To mount and stretch fabric 11, the inner U-channel 12 is placed on a flat surface and the fabric is placed into position over the inner U-channel. The outer U-channel 10, trough 20, is merely pressed over the inner U-channel to thereby sandwich the fabric in between the two U-channels as shown in FIG. 2. Although it is preferred that the inner U-channel 12 be inserted or press-fitted within outer U-channel 10 with the bottom wall 30 coinciding with the bottom of the trough 22, it is also possible that the inner U-channel 12 be flipped over and inserted or press-fitted so that the bottom wall 30 is inserted first into the outer U-channel 10. When this type of insertion is desired, the removable flange 46 must necessarily be moved from its position shown in FIGS. 2 and 3 to a position on the outward wall 34 at the top of the inner U-channel 12. This is necessary to allow insertion of the inner U-channel within the outer U-channel without also at the same time inserting the removal flange into the outer U-channel 10.

The assembled stretcher frame as shown in FIG. 1 provides a suitable permanent frame for displaying the fabric, canvas or other material stretched and held therein. Further, the removal flanges 27 and 46 allow easy and convenient removal of the inner U-channel 12 from within the outer U-channel 10 when it is desired to replace the fabric or re-use the stretcher frame. Preferably, the embroidery or stitching is performed from the bottom side of the frame as shown in FIG. 2 while the finished work is displayed with the top side of the frame as shown in FIG. 2 outward for viewing.

Having thus described an exemplary embodiment of the present invention, it will be realized by those skilled in the art that other alternative configurations and embodiments are possible. By way of example and not of limitation, the rectangular frame described above could easily be changed to a hexagonal, oval or other desirably shaped frame. Accordingly, the present invention is not limited to the embodiments as described hereinabove.

I claim:

1. A stretcher frame and a fabric held in a plane therein comprising:

(a) a first frame member including an outer polygonal U-channel portion forming a continuous channel and having U-legs at right angles to said plane and the U-legs having tips; and (b) a second frame member including an inner polygonal U-shaped portion having legs at right angles to said plane with the legs of the U-shape directed toward the legs of the U-shape of the first frame member and mated within the U-shape of the first frame member, characterized by one U-leg of the outer frame member having a rim projecting toward the other leg of the U-shape, the rim engaging the inner U-shape to lock the frame members in mated relationship, and the inner frame member having an outwardly extending flange to contact one tip of one leg of the outer U-channel to limit the inward movement of the inner frame member and to also engage said fabric in the stretcher frame, whereby said fabric is sandwiched between said inner and outer U-portions when they are mated together.

2. A stretcher frame and a fabric held in a plane therein comprising:

(a) a first frame member including an outer polygonal U-channel portion forming a continuous channel and having U-legs at right angles to said plane; and (b) a second frame member including an inner polygonal U-shaped portion having legs at right angles to said plane with the legs of the U-shape directed toward the legs of the U-shape of the first frame member and mated within the U-shape of the first frame member;

(c) a flange on each frame member generally parallel to said fabric plane, and one flange projecting outwardly of the stretcher frame, whereby the frame members are separated by manually pressing on the two flanges, whereby said fabric is sandwiched between said inner and outer U-portions when they are mated together.

3. A stretcher frame for holding fabric in a plane comprising:

(a) a first frame member including an outer polygonal U-channel portion forming a continuous channel and having U-legs at right angles to said plane;

(b) a second frame member including an inner polygonal U-shaped portion having legs at right angles to said plane with the legs of the U-shape directed toward the legs of the U-shape of the first frame member and mated within the U-shape of the first frame member;

(c) a rim on said outer first frame member projecting toward the other leg of the outer U-shape, said rim engaging the inner U-shape to lock the frames in mated relationship;

(d) and flanges disposed one on each frame member and extending generally parallel to said fabric plane, one flange projecting inwardly of the stretcher frame and the other extending outwardly of the stretcher frame, whereby the frame members are separated by manually pressing on the two flanges.

4. A stretcher frame and a fabric held in a plane therein comprising:

(a) a first frame member including an outer polygonal U-channel portion forming a continuous channel and having U-legs at right angles to said plane; and (b) a second frame member including an inner polygonal U-shaped portion having legs at right angles to said plane with the legs of the U-shape directed toward the legs of the U-shape of the first frame member and mated within the U-shape of the first frame member; and (c) transverse webs in the inner U-shaped portion for reinforcing said inner U-shaped portion whereby said fabric is sandwiched between said inner and outer U-portions when they are mated together.

5. A stretcher frame for holding fabric in a plane comprising:

(a) a first frame member including an outer polygonal U-channel portion forming a continuous channel and having U-legs at right angles to said plane;

(b) a second frame member including an inner polygonal U-shaped portion having legs at right angles to said plane with the legs of the U-shape directed toward the legs of the U-shape of the first frame member and mated within the U-shape of the first frame member;

(c) a rim on said outer first frame member projecting toward the other leg of the outer U-shape, said rim engaging the inner U-shape to lock the frames in mated relationship;

(d) and a flange on said second frame member and extending generally parallel to said fabric plane, and extending outwardly of said second frame member to engage the first frame member to limit the mating movement of the second member in the first member.

* * * * *